United States Patent [19]

Murashima

[11] Patent Number: 4,794,401

[45] Date of Patent: Dec. 27, 1988

[54] ROTATION MECHANISM FOR A WAVEGUIDE FEEDER

[75] Inventor: Shigemi Murashima, Tokyo, Japan

[73] Assignee: NEC Corporation, Japan

[21] Appl. No.: 933,023

[22] Filed: Nov. 20, 1986

[30] Foreign Application Priority Data

Nov. 30, 1985 [JP] Japan ..... 183635/85[U]

[51] Int. Cl.[4] ..... H01Q 3/12

[52] U.S. Cl. ..... 343/761; 343/890; 333/241; 333/261

[58] Field of Search ..... 343/761, 890; 333/256, 333/257, 241, 249, 261, 24 R

[56] References Cited

U.S. PATENT DOCUMENTS

| | | | |
|---|---|---|---|
| 2,520,945 | 9/1950 | Marindin | 333/261 |
| 3,890,583 | 6/1975 | Bendayan | 333/241 |
| 4,429,290 | 1/1984 | Devan | 333/241 |
| 4,475,820 | 10/1984 | Mulligan | 333/261 |

*Primary Examiner*—William L. Sikes
*Assistant Examiner*—Hoanganh Le
*Attorney, Agent, or Firm*—Laff, Whitesel, Conte & Saret

[57] ABSTRACT

A rotation mechanism for a waveguide feeder is disclosed which is applicable to an antenna rotating section of a satellite tracking antenna system and others. The mechanism includes two flexible waveguides which extend parallel to each other. The flexible waveguides are connected at one end to each other and at the other end to an upper waveguide feeder and a lower waveguide feeder, respectively.

4 Claims, 4 Drawing Sheets

ROTATION MECHANISM FOR A WAVEGUIDE FEEDER

BACKGROUND OF THE INVENTION

The present invention relates to a rotation mechanism for a waveguide feeder which is applicable to an antenna rotating section of a satellite tracking antenna system and others.

Generally, an antenna system of the kind described includes an antenna assembly having a predetermined construction and an antenna support and drive structure adapted to support and drive the antenna assembly. The antenna support and drive structure is made up of a foundation, a fixed section rigidly mounted on the foundation, and an antenna drive section rotatably mounted on the fixed section to rotate the antenna assembly. Both of the fixed section and the antenna drive section are implemented with hollow yokes so as to accommodate therein a waveguide feeder which is connected to an antenna side and another waveguide feeder which is connected to a device side. The waveguide feeder on the antenna side is rotatable together with the rotary yoke of the antenna drive section.

A majority of mechanisms heretofore proposed to rotate a waveguide feeder as stated above use a rotary joint. In a rotary joint type rotation mechanism, the stationary and the rotary yokes are rotatably interconnected through a bearing which is adapted for the rotation of the antenna. The waveguide feeders on the antenna side and the device side are interconnected by a rotary joint and allowed to rotate smoothly by a bearing associated with the rotary joint.

A problem with the prior art waveguide feeder rotation mechanism constructed as described above is that the structure is complicated due to the need for the bearing for the rotatable connection of the yokes and the bearing for the rotation of the rotary joint, resulting in a prohibitive cost.

SUMMARY OF THE INVENTION

It is therefore an object of the present invention to provide a simple and cost-effective rotation mechanism for a waveguide feeder which is applicable to an antenna rotating section of a satellite tracking antenna system and others.

It is another object of the present invention to provide a generally improved rotation mechanism for a waveguide feeder.

A rotation mechanism for a waveguide feeder installed in a satellite tracking antenna system of the present invention includes an antenna and an antenna rotating section which includes a rotary yoke for rotating the antenna about a predetermined axis and a stationary yoke. A first waveguide feeder is fixed to the rotary yoke in parallel to the axis of rotation. A second waveguide feeder is fixed to the stationary yoke in parallel to the axis of rotation. A first flexible waveguide is connected to that end of the first waveguide feeder which adjoins the second waveguide feeder, the first flexible waveguide extending perpendicular to the first waveguide feeder. A second flexible waveguide is connected to that end of the second waveguide feeder which adjoins the first waveguide feeder, the second flexible waveguide extending perpendicular to the second waveguide feeder. A coupling waveguide couples the other end of the first flexible waveguide and the other end of the second flexible waveguide to each other.

The above and other objects, features and advantages of the present invention will become more apparent from the following detailed description taken with the accompanying drawings.

DESCRIPTION OF THE PREFERRED EMBODIMENT

Figure 1:
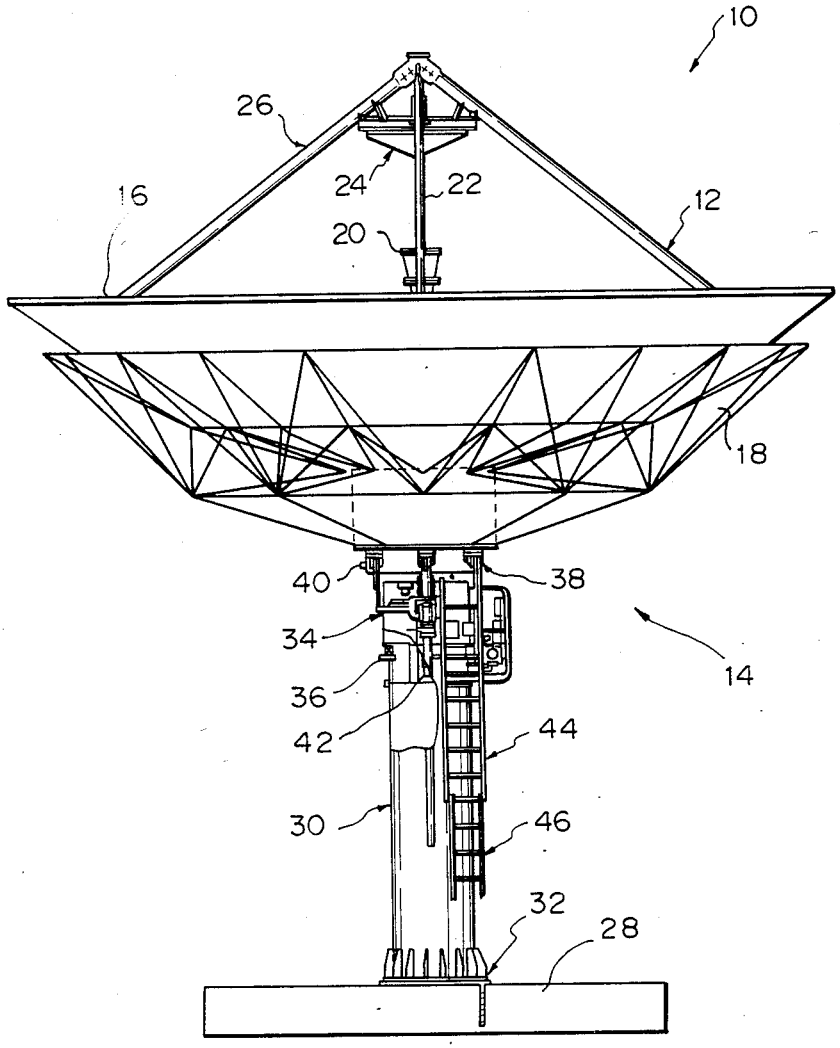
Fig. 1 PRIOR ART
FIG. 1 is a partly sectional side elevation of the structure of a prior art satellite tracking antenna system.

To better understand the present invention, a brief reference will be made to the structure of a prior art satellite tracking antenna system, shown in FIG. 1. The prior art satellite tracking antenna system of FIG. 1, generally 10, is made up of an antenna assembly 12 and an antenna support and drive structure 14 adapted to support and drive the antenna assembly 12. The antenna assembly 12 comprises an antenna dish, or surface panel, 16, a support member 18 which supports the surface panel 16, a feeder horn 20 adapted to introduce a feeder 22 through the center of the surface panel 16, a subreflector 24, and a support 26 adapted to support the subreflector 24. The antenna support and drive structure 14, on the other hand, comprises a foundation 28, a hollow mount tower, or stationary yoke, 30 which is rigidly mounted on the foundation 28 by anchor bolts 32, and a hollow rotary yoke 34 rotatably mounted on the yoke 30 through an azimuth bearing 36 so as to rotate the antenna assembly 12. The rotary yoke 34 is connected to the support member 18 of the antenna assembly 12 through an elevation bearing 38. An elevation angle detector 40 and an azimuth angle detector 42 are provided to detect elevation angle and azimuth angle, respectively. Also provided are a fixed ladder 44 and a detachable ladder 46.

Figure 2:
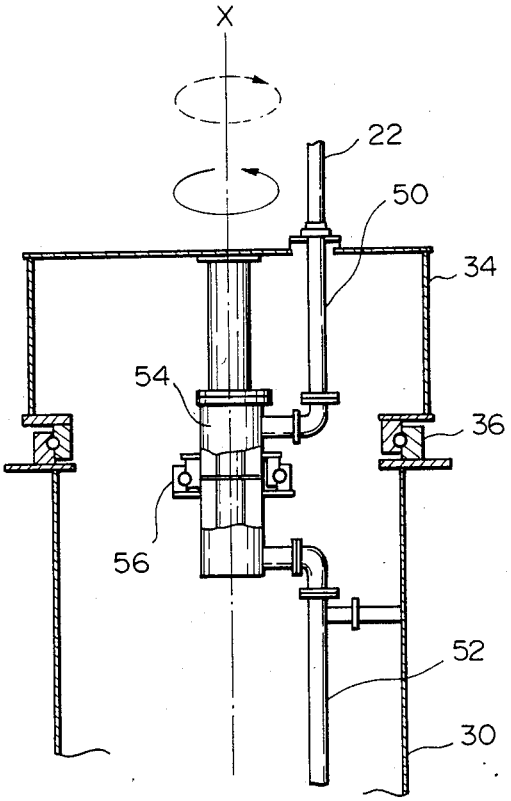
Fig. 2 PRIOR ART
FIG. 2 is a fragmentary sectional side elevation of a prior art rotary joint type rotation mechanism for a waveguide feeder.

A prior art rotary joint type rotation mechanism is disposed in the vicinity of that portion of the system 10 where the stationary and rotary yokes 30 and 34 are interconnected, i.e. a hollow portion adjacent to the azimuth bearing 36. The structure of that particular portion of the system 10 is shown in an enlarged scale in FIG. 2. Specifically, as shown in FIG. 2, the rotary yoke 34 which is mounted on the antenna assembly 12 and rotatable about an axis X is joined to the stationary yoke 30 by the azimuth bearing 36, which is adapted for the rotation of the antenna. A waveguide feeder 50 connected to the antenna assembly 12 and a waveguide feeder 52 connected to a stationary device, not shown, are interconnected by a rotary joint 54 which is rotatable smoothly with the aid of a exclusive bearing 56.

A drawback inherent in this type of prior art rotation mechanism for a waveguide feeder is that the structure is complicated and, therefore, expensive, as previously discussed.

Figure 3:
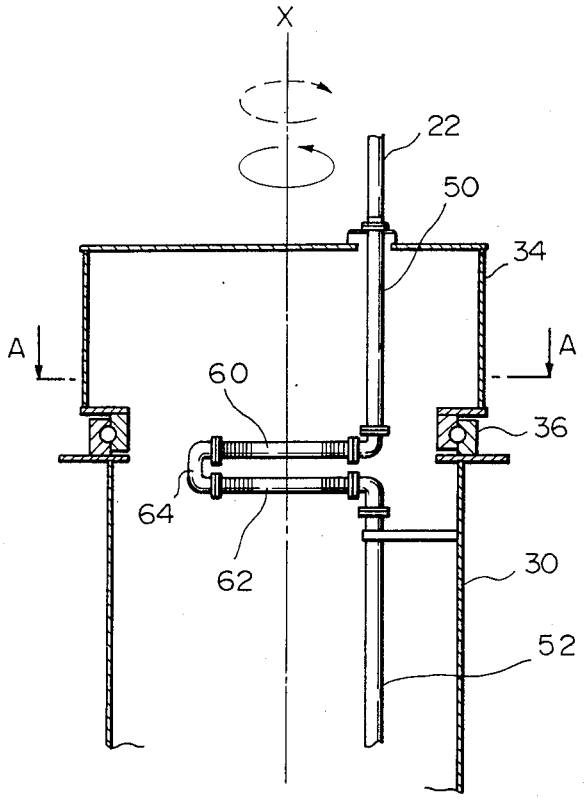
FIG. 3 is a fragmentary sectional side elevation showing the structure of a rotation mechanism embodying the present invention.
Figure 4A:
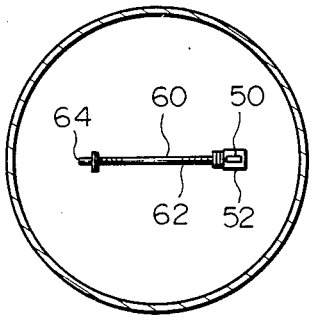
FIGS. 4A and 4B are sections along line A—A of FIG. 3 showing that portion of the rotation mechanism where flexible waveguides are interconnected, in conditions before and after rotation, respectively.
Figure 4B:
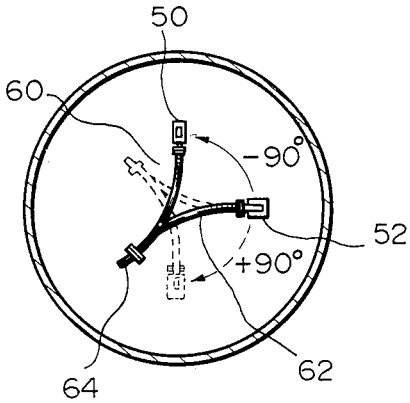

Referring to FIGS. 3, 4A and 4B, a waveguide feeder rotation mechanism embodying the present invention is shown which is free from the above-described drawback. In FIGS. 3, 4A and 4B, the same or similar structural elements as those shown in FIG. 2 are designated by like reference numerals.

As shown in FIG. 3, a flexible waveguide 60 is connected to the lower end of and perpendicular to a waveguide feeder 50 which leads to an antenna. Another flexible waveguide 62 is connected to the upper end of and perpendicular to a waveguide feeder 52 which leads to a stationary device, not shown. The waveguides 60 and 62 are interconnected at their other end by a generally U-shaped waveguide 64. The waveguides 60 and 62 may be of the convoluted type.

FIGS. 4A and 4B show that part of FIG. 3 where the flexible waveguides 60 and 62 are interconnected, in conditions before and after rotation, respectively. Specifically, before the axis of rotation X is rotated, the waveguides 60 and 62 extend one above the other and parallel to each other, as shown in FIG. 4A. When the axis is rotated counterclockwise as seen from the above, i.e., −90 degrees, as represented by solid lines in FIG. 4B, the waveguides 60 and 62 are individually bent to allow the waveguide feeder 50 to move to a position which is angularly spaced 90 degrees from the other waveguide feeder 52. Even under the deformation as shown in FIG. 4B, the waveguides 60 and 62 assure the interconnection of the feeders 50 and 52. When the axis X is rotated clockwise as seen from the above, i.e., +90 degrees from the position of FIG. 4A, the waveguides 60 and 62 are bent as represented by phantom lines in FIG. 4B, again maintaining the feeders 50 and 52 in perfect interconnection.

In summary, it will be seen that the present invention provides a rotation mechanism for a waveguide feeder which is simple and cost-effective since a complicated and expensive rotary joint is needless.

Various modifications will become possible for those skilled in the art after receiving the teachings of the present disclosure without departing from the scope thereof.

What is claimed is:

1. A rotation mechanism for a waveguide feeder installed in a satellite tracking antenna system which includes an antenna and an antenna rotating section which includes a rotary yoke for rotating said antenna about a predetermined axis and a stationary yoke, said rotation mechanism comprising;

a first waveguide feeder fixed to said rotary yoke in parallel to said axis of rotation;

a second waveguide feeder fixed to said stationary yoke in parallel to said axis of rotation;

a first flexible waveguide connected to that end of said first waveguide feeder which adjoins said second waveguide feeder, said first flexible waveguide extending perpendicular to said first waveguide feeder;

a second flexible waveguide connected to that end of said second waveguide feeder which adjoins said first waveguide feeder, said second flexible waveguide extending perpendicular to said second waveguide feeder; and a coupling waveguide coupling the other end of said first flexible waveguide and the other end of said second flexible waveguide to each other.

2. A rotation mechanism as claimed in claim 1, in which said first and second flexible waveguides are of a convoluted type.

3. A rotation mechanism as claimed in claim 1, in which said coupling waveguide is U-shaped.

4. A rotation mechanism as claimed in claim 1, wherein each of the two flexible waveguides has a length which extends beyond the rotation axis X.

* * * * *